United States Patent [19]

Meisner et al.

[11] 3,950,939

[45] Apr. 20, 1976

[54] DIGITAL DISPLAY WITH STEPPING DEVICE

[75] Inventors: Alfred Meisner; Oskar Oellig, both of Nurnberg; Josef Neubauer, Grossschwarzenlohe; Walter Trimpler, Lupburg, Opf.; Erwin Potthof, Rothebach, P., all of Germany

[73] Assignee: DIEHL, Nurnberg, Germany

[22] Filed: Feb. 6, 1975

[21] Appl. No.: 547,882

[30] Foreign Application Priority Data

Feb. 22, 1974 Germany ..... 2408539

[52] U.S. Cl. ..... 58/125 C; 116/129 H

[51] Int. Cl.[2] ..... G04B 19/02; G09F 9/00

[58] Field of Search ..... 58/2, 4, 6, 125 C, 126 E, 58/127, 128; 116/129 R, 129 H, 133, DIG. 37

[56] References Cited

UNITED STATES PATENTS 3,910,032 10/1975 Funaki et al. ..... 58/125 C

*Primary Examiner*—George H. Miller, Jr.

*Attorney, Agent, or Firm*—Haseltine, Lake & Waters

[57] ABSTRACT

A twenty-four hour digital display in which the numerals for the display are carried by a 1-hour barrel and a 10-hour barrel which are stepped by a stepping device. A steppable visor driven in steps by the 10-hour barrel covers part of the time the 1-hour barrel which has a function of the time display. The visor itself carries numerals for indicating single-digit hours. The stepping device includes a gearing and a shaft which serves simultaneously as a locking device for the two barrels.

4 Claims, 6 Drawing Figures

DIGITAL DISPLAY WITH STEPPING DEVICE

BACKGROUND OF THE INVENTION

This invention relates to a digital display with a stepping device which uses barrels for carrying the numbers, especially for a 24-hour display.

Digital 24-hour displays are already known in the art. Such displays are equipped, for example, with rotating disks running past a display window. Sometimes these displays are drop-leaf or tape displays. These known displays have the disadvantage that they are either difficult to manufacture and hence expensive, or that they require a lot of space. There are also known 24-hour displays which use barrels for carrying the numbers. Up to now, these 24-hour displays had the disadvantage that one could not optimize the ratio of the constructed number height to the barrel diameter, and hence the construction height of the digital display by means of a maximum number height and a minimum barrel size.

If the number height was made as large as desired, the barrel diameter and hence the construction height of the display became too large. If on the other hand, one preselected the construction height and hence the barrel diameter, the number height inscribable on the barrels become too small so that it could only be read with difficulty. In addition, such digital displays with barrels for bearing numbers mostly use a jack stepping device which has the disadvantage that the time display cannot be corrected in both directions, i.e., in the plus or minus direction.

Furthermore, these digital display barrels have the disadvantage that either at least 12 numbers must be accommodated on a barrel, or that, when accommodating less than 12 numbers on the barrel, expensive and still not reliably stepping reset mechanisms for the barrels had to be installed. Another disadvantage of known digital displays with digit barrels is that the number lettering is interrupted several times, e.g., by mask mountings located in front of the barrels so that definite and clear reading of the numbers is made difficult. These interruptions of the number lettering can be eliminated only by expensive and not always perfect auxiliary mechanisms.

Accordingly, it is an object of the present invention to provide an inexpensive digital display suitable for mass production and requiring little assembly effort and to improve the ratio of maximum number letter height to minimum construction height and hence a minimum barrel diameter. At the same time, it is the object of the present invention to reduce to a minimum the space requirement of the stepping device for the 24-hour display.

Another object of the present invention is to provide an arrangement of the foregoing character which is simple in design and may be readily fabricated.

A still further object of the present invention is to provide an arrangement, as described, which has a substantially long operating life and may be economically maintained in service.

SUMMARY OF THE INVENTION

The objects of the present invention are achieved by providing that the 24-hour display takes place in a conventional manner separately through a 1-hour barrel and through a 10-hour barrel. A visor steppable by driving the 10-hour barrel step-by-step as a function of the time displayed, covers partially the 1-hour barrel, with the visor field bearing digits for the display of single-digit hours. In an advantageous embodiment of the invention the visor is attached to the 10-hour barrel. In one form of construction of the invention, the visor is of one-piece construction with the 10-hour barrel. In an advantageous form of construction, the stepping device for the 1-hour barrel and for the 10-hour barrel, consisting of one gear, one shaft and another gear, serves simultaneously as a locking device for the two hour barrels. A further embodiment of the invention provides that the locking devices for the 2-hour barrels are constructed as cylinder locks. In a still further embodiment of the invention, the 10-minute barrel, in addition to the teeth, has a circular locking ring with two interruptions and one ratchet tooth. It is advantageous to make the 10-minute barrel with the teeth, the locking ring and the ratchet tooth in one piece. The hourly steps of the 10-minute barrel are transmitted to the stepping device for the 2-hour barrels by means of the ratchet tooth of the locking ring with its two interruptions to the stud teeth of the gear.

The advantages of the invention are as follows: Except for some shafts, all parts can be made from plastic, facilitating mass production. The digital display of the subject invention facilitates optimum ratio of the size of the display numbers to the construction height of the entire display, or to the barrel diameter. However, the digital display of the present invention avoids the disadvantages arising from conventional jack stepping.

Thus, with a jack stepping device one must disengage so that there is no longer a positive interlock between display and, for example, a connected time switch. With the display of the present invention, the positive interlock is always maintained and the possibilities or error arising from stepping with a jack stepping device can be avoided. The stepping and locking device of the present invention makes possible this positive interlock with a minimum of manufacturing and assembly costs. In addition, the stepping and locking device of the present invention considerably reduces the conventional space requirement for a 24-hour display.

The novel features which are considered as characteristic for the invention are set forth in particular in the appended claims. The invention itself, however, both as to its construction and method of operation, together with additional objects and advantages thereof, will be best understood from the following description of specific embodiments when read in connection with the accompanying drawings.

DESCRIPTION OF THE PREFERRED EMBODIMENTS

Figure 1:
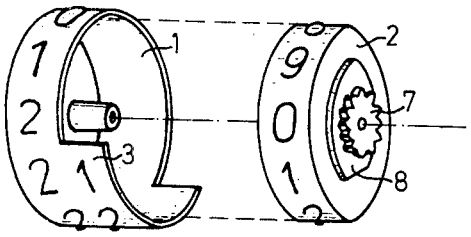
FIG. 1 is a perspective view of the 1-hour barrel and the 10-hour barrel, in accordance with the present invention.

FIG. 1 shows a perspective view of a 10-hour barrel 1 and a 1-hour barrel 2. The 10-hour barrel has a visor 3 which is part of that barrel, and can be produced in one operation by direct injection molding. It may also be fastened in any other manner to the barrel. The purpose of this visor is to cover the digital sequence on the 1-hour barrel 2 as a function of the displayed time for a certain time interval. The 10-hour roll or barrel 1 carries along its periphery the numerals 1, 2, 21, 22, and 23. The remainder of the periphery of the numerical barrel 1 is inscribed with zeroes. This part of the periphery may also remain without inscription. On that part of the periphery of the numbered barrel 1 which mounts the visor 3, the numerals 21, 22, and 23 are inscribed, it covers the 1-hour barrel 2.

Figure 2:
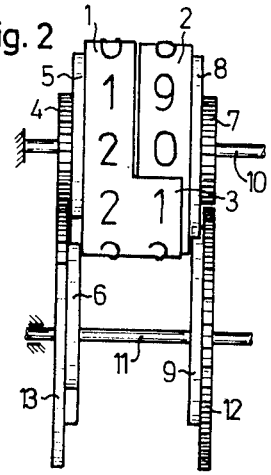
FIG. 2 is a top view and shows the 1-hour barrel and the 10-hour barrel with stepping device and locking device.
Figure 3:
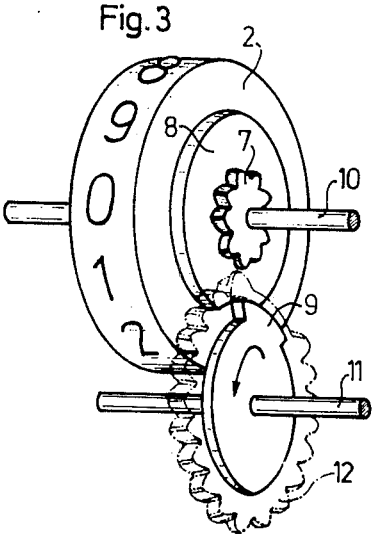
FIG. 3 is a perspective view of the 1-hour barrel with stepping device and locking device.
Figure 4:
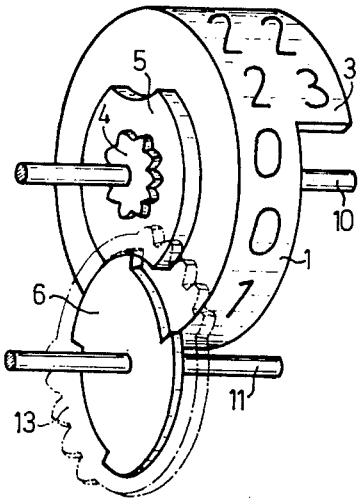
FIG. 4 is a perspective view of the 10-hour barrel with stepping device and locking device.

As evident from FIGS. 2 and 4, the 10-hour barrel 1 has a gear 4 and the one part 5 of the cylinder lock for the 10-hour barrel. The gear 4 and that one part 5 of the cylinder lock are fixed to numbered barrel 1. Preferably, the numbered barrel 1, the gear 4 and the one part 5 of the cylinder lock are of one piece made, for example, from plastic injection molding. The 1-hour barrel 2 bears on its periphery the numbers 0, 1, 2, 3, 4, 5, 6, 7, 8, and 9. As evident from FIGS. 1, 2, and 3, there is fixed to numbered barrel 2 a gear 7, as well as the one part 8 of the cylinder lock for the 1-hour barrel. Again the numbered barrel 2, the gear 7 and the one part 8 of the cylinder lock are preferably of one piece and made of plastic injection molding.

The mode of operation of the digital 24-hour display of the present invention will be explained in detail below. As shown in FIG. 2, the 10-hour barrel 1 and the 1-hour barrel 2 are mounted easily rotatable on a shaft 10. Another shaft, a shaft 11, mounts in a fixed manner gears 12 and 13. Rigidly connected to gear 12 is the other component 9 of the cylinder lock for the 1-hour barrel 2. Rigidly connected to gear 13 is the other component 6 of the cylinder lock for the 10-hour barrel 1. Upon completion of each hour, shaft 11 and hence gears 12 and 13 rotate by 15° which corresponds to 1/24 of one full revolution. This stepwise rotary movement is derived from the 10-minute barrel. It can, for example, be transmitted to shaft 11 by a Maltese-cross transmission or similar devices. Each of these rotary movements, hence the hourly steps, are transmitted by means of gear 12 to gear 7 of 1-hour barrel 2. As a result, the 1-hour barrel 2 is moved each time by one step or one number.

The stepping device, which consists of gear 13, shaft 11, and gear 12 is designed in such a way that during the first five steps, the 10-hour barrel 1 remains at rest, since on gear 13 belonging to the 10-hour barrel 1, the teeth are missing at this point. At the same time, the locking device for the 10-hour barrel 1, which consists of a cylinder lock with components 5 and 6, effects an interlock against rotation of the 10-hour barrel 1 while it stands still. Only with the 5th hourly step of shaft 11 does gear 13 come into mesh with gear 4 belonging to the 10-hour barrel. With the 6th, 7th, 8th, 9th, and 10th step, both the 1-hour barrel and the 10-hour barrel are rotated at the same time. During the 1st through 9th step, the 10-hour barrel 1 always displays a zero in the display window. That means, during the 1st through 5th step, the 10-hour barrel displays a fixed zero in the display window, but during the 6th through 9th step a stepped zero is in the display window. With the 10th step the number 1 appears in the display window of the 10-hour barrel 1.

During the 11th through 19th step of shaft 11, the teeth are again left out on gear 13, so that number 1 of the 10-hour barrel 1 remains in the display window. By suitable design of the locking device belonging to the 10-hour barrel 1, namely the cylinder locks with parts 5 and 6, the 10-hour barrel 1 is prevented from rotation during the 11th through 19th step. Before the 20th step, the cylinder lock is disconnected from parts 5 and 6, so that with the 20th step gear 13 again comes into mesh with gear 4 and the 10-hour barrel now makes a step together with the 1-hour barrel 2. As a result of the 20th step, number 2 appears in the display window on the 10-hour barrel, while number zero appears on the 1-hour barrel, so that the number 20 appears in the display window (not shown).

By suitable design of the locking device provided for 1-hour barrel 2, with the locking device consisting of a cylinder lock with components 8 and 9, the 1-hour barrel 2 is locked after the 20th step so that number zero appears in the display window. While shaft 11 performs the 21st, 22nd, 23rd, and 24th step, and with it gears 12 and 13, because of the locking action of the 1-hour barrel 2, only the 10-hour barrel 1 can be stepped. Beginning with the 21st step, visor 3 attached to the 10-hour barrel 1 covers the 1-hour barrel 2. With each hourly step there appear in the display window of the digital display the numbers 21, 22, 23. Upon completion of the 24th hour and the 24th step, the visor attached to the 10-hour barrel moves out of the display window of the 1-hour barrel and opens the view on the 1-hour barrel 2 in which a fixed number zero is visible, since the 20th step. Upon completion of the 24th step, the lock for the 1 -hour barrel 2, consisting of cylinder lock 8 and 9, is released at the same time. Of course, it is possible to select other combinations for the periods of standstill of the 10-hour barrel 1.

The stepping device consisting of gears 12 and 13 and shaft 11, is simultaneously designed as locking device. The components 6 and 9 of the cylinder locks for the 10-hour barrel 1 and the 1-hour barrel 2 are integrated into the stepping device and are part of it as one piece. Also parts 5 and 8 of the cylinder locks for the 10-hour barrel 1 and the 1-hour barrel 2 are integral with gears 4 and 7 and the respective barrels.

Figure 5:
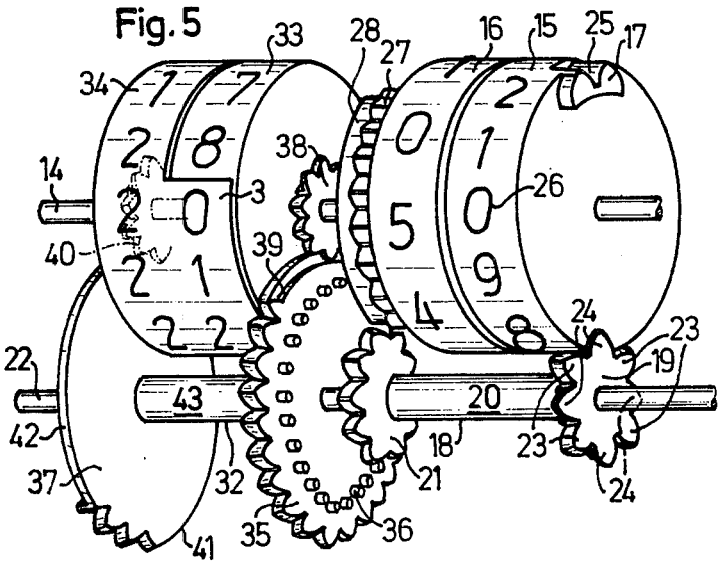
FIG. 5 is a perspective view of another form of construction of the digital display.

In a further embodiment of the invention, shown in FIG. 5, the digital display comprises a 24-hour display with barrels and a minute display with barrels. A shaft 14 mounts loosely rotatable a 1-minute barrel 15 and a 10-minute barrel 16. The 1-minute barrel 15 is driven by a time standard (not shown), for example, a synchronous motor. An associated drive and a notched star which fixes the position of the 1-minute barrel 15 also is not shown in FIG. 5. The 1-minute barrel 15 has teeth 17 consisting of two teeth. The teeth 17 are designed so that the gap between the two teeth in the axial direction is wider than each tooth itself. On the 1-minute barrel 15, the numbers 0 through 9 are inscribed. As a result of a drive controlled by the time standard, the 1-minute barrel 15 makes a step every minute, so that a minute display appears through a display window (not shown). Because of these steps, every 10 minutes, the teeth 17 of the 1-minute barrel 15 contact a gear 19 of a stepping device 18 which consists of the above-mentioned gear 19, a bushing 20 and a gear 21.

The gears 19 and 21 are rigidly attached to bushing 20 while the bushing is rotatable on a shaft 22. For example, the stepping device 18 may have the form of a single-piece injection molding. The stepping device 18 is used for transmitting the step started every 10 minutes by the teeth 17 of the 1-minutes barrel to the 10-minute barrel 16. The stepping device 18 for the 10-minute barrel 16 is simultaneously designed as the locking device as will be explained below. For this purpose, four of the eight teeth of gear 19 are only about half as wide as the remaining teeth. This means that next to a wide tooth, alternately a tooth only half as wide is located.

The stepping device 18 and hence the position of the gear 19 in relation to the 1-minute barrel 15 on shaft 22 is arranged so that at an instant when the 10-minute barrel 16 is not to be stepped, there are two full-width teeth 23 of gear 19 located along the periphery of the 1-minute barrel 15, while an in-between tooth 24 of gear 19 can run past barrel 15 since it has only half the tooth-width of the adjacent teeth 23. Hence this position of gear 19 of the stepping device 18 serves as a lock for the continued stepping of 10-minute barrel 16. The stepping device 18 thus serves simultaneously as the locking device for the 10-minute barrel 16. Only upon completing the 10th minute, hence the 10th step, does the first tooth of teeth 17 of the 1-minute barrel 15 touch a full-width tooth 24 of gear 19 and thus starts to rotate the stepping device 18 by one step. A full-width tooth of gear 19 enters a full-width tooth opening 25 of teeth 17 of gear 23 and the locking effect of gear 19 is discontinued. The tooth gap 25 of teeth 17 extends into the periphery of the digit field 26 of the 1-minute barrel 15 as far as the full-width teeth 23 of gear 19 adheres to this periphery.

Upon mating with the teeth 17, the gear 19 of the stepping device is rotated by two teeth which corresponds at a 90° rotation of stepping device 18. By means of gear 21 of the stepping device and a suitably designed gear 27 associated with the 10-minute barrel 16, the 90° rotation performed by the stepping device 18 is reduced to a 60° rotation of the 10-minute barrel 16. In contrast with the 1-minute barrel 15 along whose periphery the digits 1 through 9 are inscribed, the 10-minute barrel 16 bears digits 0 through 5. This corresponds to an angular step of 60° from digit to digit.

Figure 6:
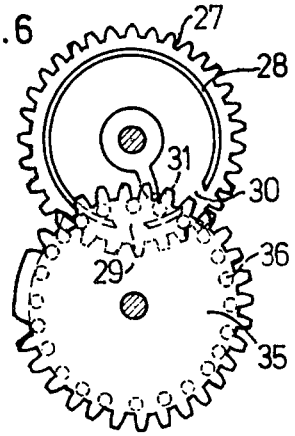
FIG. 6 shows the layout of the 10-minute barrel and a gear of the stepping device for transmitting the hourly steps from the 10-minute barrel.

The 10-minute barrel 16 has, besides a gear 27, a circular locking ring 28 with two interruptions 29 and 30 and a ratchet tooth 31 as is shown in FIG. 5 and 6. The 10-minute barrel 16 is preferably made in one piece with the gear 27, the locking ring 28 and the ratchet tooth 31, and manufactured through plastic injection molding. The locking ring 28 with two interruptions 29 and 30 and the ratchet tooth 31, in accordance with the present invention, in conjunction with a stepping device 32 for a 1-hour barrel 33 and a 10-hour barrel 34, are used to transmit the hourly steps from the 10-minute barrel 16 to these 2-hour-barrels. The stepping device 32 consists of a bushing 43, and gears 35, 37, with bushing 43 loosely rotatable around shaft 22. The 1-hour barrel 33 and the 10-hour barrel 34, like the minute barrels, are loosely rotatable around shaft 14.

In order to make possible the transmission of the hourly steps from the 10-minute barrel 16 to the stepping device 32, the gear 35 of the stepping device has twenty-four studs 36 uniformly distributed on the plane surface facing the 10-minute barrel 16. Upon completion of the 60th minute, ratchet tooth 31 engages the stud teeth 36 of gear 35, to transmit the hourly steps from the 10-minute barrel 16. Because of suitable interruptions 29 and 30 in locking ring 28, which rotate together with the ratchet tooth 31, the latter can rotate the gear 35 by exactly one step. A further step is prevented because of the travel of the locking ring 28 between the studs 36. The angle of rotation traversed by the gear 35 is dimensioned so that it corresponds to a rotation of 1/24 of a revolution. This means that during 24 hours, the stepping device 32 makes one revolution.

Gear 35 of the stepping device is positively locked with a gear 38 which is a component of the 1-hour barrel and is used for driving this barrel. The full-width teeth of gears 35 and 38 are of equal width and face one another in the same plane. Gear 38 associated with the 1-hour barrel has ten teeth. One of these teeth has only half-tooth width. On its frontal surface, gear 35 has 24 minus 4, hence 20 teeth, which may be involute teeth or any other type. Because of the twenty four studs 36, the gear 35 nevertheless makes twenty-four steps per hour. In place of the omitted four teeth of the frontal teeth of gear 35, the crown circle 39 of this gear has half-tooth width from the 20th tooth to the first tooth. This crown circle 39 has half tooth width and, in conjunction with the accordingly-shaped tooth of gear 38 of the 1-hour barrel 33, forms a cylinder lock. This cylinder lock for the 1-hour barrel 35 is laid out so that it is effective from the 19th to the 23rd hour. That means, the 1-hour barrel 33 makes two full revolutions which correspond to twice the display from 0 to 9, or 20 steps. The twenty teeth of gear 35 are all half the full tooth width of gear 38. Therefore the tooth of gear 38 is stepped by the teeth of gear 35. Hence the 1-hour barrel 33 can make twenty steps one after the other.

Beginning with the 19th hour, corresponding to the position after the 20th step, up to and including 23rd hour, two full-width teeth of gear 38 come in contact with the half-width crown circle 39 of gear 35. However, the full-width teeth of gear 38 cannot run past the crown circle, and the cylinder lock for the 1-hour barrel 33 becomes effective. Therefore, from the 19th up to and including the 23rd hour, the digit barrel cannot continue to rotate. In contrast with the 1-hour barrel 33 blocked by the cylinder lock, gear 35 can continue to rotate. As before, it is stepped by the ratchet tooth 31 of the 10-minute barrel 16 every hour. The digit 9 remains in the display window, till with the 24th step of the digit wheel 35, a wide tooth of gear 38 can mesh with the teeth of gear 35. At that instant, the cylinder lock for the 1-hour barrel is released and the barrel is stepped by one step, digit 0 appears in the display window.

The stepping device 32, with its tooth 35, serves not only for stepping the 1-hour barrel 35, but also for stepping the 10-hour barrel 34. This is accomplished by means of gear 37, which is mounted rigidly to bushing 43 which, in turn, is rigidly connected to gear 35. The bushing 43 is loosely rotatable on shaft 22. The stepping device 32 may be a one-piece injection molding. Hence gear 37 is rotated one step with every step performed by gear 35. It is in continuous mesh or contact with a gear 40 (shown by a broken line) belonging to the 10-hour barrel 34. This gear 40 is similar to gear 38 for the 1-hour barrel 33. Along its periphery it has 10 teeth, eight of which are full width, while the two remaining ones have only half the width of the other teeth. Three full-width teeth are followed by a half-width tooth and after five more full-width teeth there comes again a half-width tooth. Gear 37 of stepping device 32, in mesh with gear 40, is used for driving the 10-hour barrel 34.

In conjunction with gear 40, gear 37 is used not only in stepping, but also as a lock for the 10-hour barrel. It is designed as follows. Gear 37 has teeth 24 minus 7 minus 7, this means through proper arrangement, the first to the 7th tooth and the 12th to the 18th tooth are left out on the periphery of the gear. The omitted teeth between the 24th and the 8th tooth are replaced by continuing the crown 41 of gear 37 with half-tooth width. Also, the omitted teeth between the 11th and the 19th tooth are replaced by continuing the crown circle 42 of the same gear 37 with half-tooth widths. Crown circles 41 and 42, in conjunction with the alternately full- and half-width teeth of gear 40, constitute two cylinder locks for the 10-hour barrel. Thus the stepping device 32 with its gear 37 serves also as the locking device for the 10-hour barrel.

The 24-hour display and the hourly stepping for the 1-hour barrel 33 and the 10-hour barrel 34 proceeds as follows. Ratchet tooth 31 rotates the stepping device 32 by meshing with the studs 36 of gear 35 by one step every hour. A full revolution requires 24 steps, one step corresponds to an angle of rotation of 15°. However, one step of gear 35 steps the whole stepping device 32 by one step since gear 35 is rigidly connected to gear 37 through bushing 43. Gears 35 and 37, in conjunction with gears 38 and 40, of the 1-hour barrel 33 and of the 10-hour barrel 34, respectively, translate each step of 15° rotation into a 36° rotation of the 1-hour barrel 33 and 10-hour barrel 34. By suitably arranging crown circles along the circumference of gears 35 and 37, which form the cylinder locks in conjunction with gears 38 and 40, the 1-hour barrel 33 and the 10-hour barrel 34 are alternately stepped or locked in a positive fashion.

In order to satisfy the requirements of the present invention, the 10-hour barrel 34 must bear at least the numbers 1, 2, 21, 22, and 23. However, for design reasons, the number 20 rather than number 2 was chosen. In order to obtain for the 10-hour barrel 34 the same gear ratio as for the 1-hour barrel 33, i.e., a division by ten, the digit barrel 34 is incribed with digits 1 and 0. The digit 0 can either be omitted entirely or used continuously, as required.

Through a suitable design of gear 35, from the first to the seventh hour, only gear 35 and hence also gear 38 or the 1-hour barrel 33 is stepped. During the first to seventh hour, the 10-hour barrel 34 shows a digit 0 in the display window. During this time interval, the 10-hour barrel 34 is locked since along the circumference of gear 37 the 1st through 7th tooth are missing and instead a crown circle is provided with half the width of the teeth of the two gears 37 and 40. During the time interval between the 1st and 7th hour, a cylinder lock is in effect due to the crown circle 41 in conjunction with gear 40. During the locking interval, two full-width teeth of gear 40 mesh with crown circle 41, while the inbetween half-width tooth of gear 40 may pass by the crown circle which has only half-tooth width.

From the completion of the eigth hour to the completion of the 11th hour, the 1-hour barrel 33 and the 10-hour barrel 34 revolve together, since upon completion of the 8th hour the cylinder lock effective at the 10-hour barrel 34 is released, and a wide tooth of gear 40 can mesh with a tooth gap of gear 37. As already described, the 1-hour barrel 33, because of the design of tooth 35, runs twice through the positions from 0 to 9 without a lock being in effect on the 1-hour barrel. In the display window there appears on the 10-hour barrel 34 during the 8th and 9th hour, a stepped digit 0. During the 1st through 7th hour, the 10-hour barrel 34 displays a fixed digit 0 in the display window. Upon completion of the 10th and the 11th hour, digit 1 becomes visible in the display window of the 10-hour barrel.

Beginning with the 12th hour up to the 18th hour, digit 1 remains in the display window of the 10-hour barrel 34, since after the 11th hour the second cylinder lock for the 10-hour barrel becomes effective. It is caused by the crown circle 42 in conjunction with gear 40. Upon completion of the 19th hour there takes place a common step of the 1-hour barrel 33 and the 10-hour barrel 34. The 1-hour barrel 33 exhibits a digit 9 and the 10-hour barrel 34 exhibits a stepped digit 1 in the display window.

From the 19th up to and including the 23rd hour, the 1-hour barrel 33 remains at rest because the cylinder lock on gear 35 becomes effective. The cylinder lock is brought about by the crown circle 39 in conjunction with the gear 38. However, the 10-hour barrel is stepped from the 19th up to and including 23rd hour, since after the 18th hour the cylinder lock effective from the 12th to the 18th hour was released. The visor 3 attached to the 10-hour barrel 34 is fastened to this barrel in such a way that beginning with the 20th hour, the visor 3 covers the 1-hour barrel 33. The visor bears the single-digit hours 0, 1, 2, and 3 for the 20th 21st, 22nd, and 23rd step or the respective displayed hour. Beginning with the 20th up to and including the 23rd hour, the 10-hour barrel 34 shows a stepped digit 2 in the display window.

In the display window there are visible from the 20th to and including the 23rd hour, the numbers 20, 21, 22, and 23. During these steps, as mentioned above, the 1-hour barrel 33 is covered and prevented from stepping by the cylinder lock in effect from the 19th to the 23rd hour. Upon completing the 24th hour, the 1-hour barrel 33 and the 10-hour barrel 34 are again moved jointly by one step. The visor 3 of the 10-hour barrel 34 moves out of the display window of the 1-hour barrel 34, so that the view onto the 1-hour barrel 33 is clear again. Through the common step of the 1-hour and the 10-hour barrel upon completing the 24th hour, the digit 0 becomes visible in the display window of the two barrels.

In summary, the ratio of a maximum quantity in relation to a minimum barrel diameter can be improved by the present invention as follows: On the 1-hour barrel 33 only 10 digits are inscribed, while up to now always 12 numbers were inscribed on the 1-hour barrel for a 24-hour display if one wanted to avoid an expensive reset mechanism for the 21st through the 24th hour. These measures save expense and space and the susceptibility to errors of such reset mechanisms. Also, except for the shafts, practically all parts can be made from plastic injection molding, which in mass production is particularly inexpensive. In addition, the present invention of a 24 digital display, both in the construction of the display barrels with the associated gears and the corresponding stepping devices which simultaneously act as locking devices, makes possible a positive lock between the time standard or the display drive, on the one hand, and the actual time passed.

The invention eliminates all stepping errors which might arise, for example, when one must disengage or disconect as is required from jack stepping. Errors resulting from interrupted form-locking between a time switch and its digital display lead to display errors which cannot be corrected at once, since the error cannot be identified.

The subject digital display also has the decisive advantage that, in regulating, a forward and backward correction can be made, while, for example, with drop leaf display or jack stepping, a display correction can be made only in the forward direction.

Without further analysis, the foregoing will so fully reveal the gist of the present invention that others can, by applying current knowledge, readily adapt it for various application without omitting features, that, from the standpoint of prior art, fairly constitute essential characteristics of the generic or specific aspects of this invention, and therefore, such adaptations are intended to be comprehended within the meaning and range of equivalence of the following claims.

We claim:

1. A digital 24-hour display comprising, in combination, a 10-minute barrel (16), a one-hour barrel (33), and a 10-hour barrel (34), each bearing numerals for the display, a visor (3) constituting part of said 10-hour barrel and covering said one-hour barrel part of the time, also bearing numerals for indicating single-digit hours during said part of the time, a mechanism (32) for incrementally advancing said barrels part of the time upon advancement of said 10-minute barrel, also serving as a locking mechanism for at least one of said hour barrels, said advancing mechanism including on said 10-minute barrel a continuous first gear (27), a locking ring (28) with at least two interruptions (29, 30) therein and a switching tooth (31), said advancing mechanism further including a second gear (35), associated with said one-hour barrel, being mounted for incremental rotation out-of axis with said barrels, partly facing said 10-minute barrel with a planar surface, and having a plurality of pin teeth (36) uniformly divided over a circular radius on said planar surface of the second gear, and means for continuously transferring hourly steps from said 10-minute barrel onto said advancing mechanism, and subsequently to at least one of said hour barrels by means of said switching tooth and said locking ring with its interruptions, acting on said pin teeth of the second gear.

2. The digital display as defined in claim 1, wherein said second gear (35) and a third gear (37) are rigidly connected by a shaft (32), these gears serving for advancing and simultaneously locking both said hour barrels (33, 34).

3. The digital display as defined in claim 1, wherein said 10-minute barrel (16) is made in one piece with said first gear (27), said locking ring (28) and with said switching tooth (31).

4. The digital display as defined in claim 1, wherein said pin teeth (36) are made in one piece with said second gear (35).

* * * * *